US008542839B2

(12) United States Patent
Son et al.

(10) Patent No.: US 8,542,839 B2
(45) Date of Patent: Sep. 24, 2013

(54) AUDIO PROCESSING APPARATUS AND METHOD OF MOBILE DEVICE

(75) Inventors: Chang Yong Son, Gunpo-si (KR); Do Hyung Kim, Hwaseong-si (KR); Sang Oak Woo, Anyang-si (KR); Kang Eun Lee, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 697 days.

(21) Appl. No.: 12/382,562

(22) Filed: Mar. 18, 2009

(65) Prior Publication Data

US 2010/0104106 A1 Apr. 29, 2010

(30) Foreign Application Priority Data

Oct. 23, 2008 (KR) ..... 10-2008-0104001

(51) Int. Cl.
*H04R 5/00* (2006.01)
*G10L 13/00* (2006.01)

(52) U.S. Cl.
USPC ..... 381/17; 381/18; 381/23; 381/61; 704/258

(58) Field of Classification Search
USPC ..... 381/17, 18, 23, 61, 202; 704/258
See application file for complete search history.

(56) References Cited

U.S. PATENT DOCUMENTS

| | | | | |
|---|---|---|---|---|
| 6,011,851 | A * | 1/2000 | Connor et al. | 381/17 |
| 2002/0057333 | A1 * | 5/2002 | Mayuzumi | 348/14.1 |
| 2007/0237495 | A1 * | 10/2007 | Terada et al. | 386/96 |

FOREIGN PATENT DOCUMENTS

| | | |
|---|---|---|
| KR | 10-2007-0028481 | 3/2007 |
| KR | 10-2007-0051915 | 5/2007 |
| KR | 10-2007-0061872 | 6/2007 |
| KR | 10-2007-0065314 | 6/2007 |
| KR | 10-2007-0100838 | 10/2007 |
| KR | 10-2008-0042160 | 5/2008 |
| KR | 10-2008-0047446 | 5/2008 |
| KR | 10-2008-0074223 | 8/2008 |

* cited by examiner

*Primary Examiner* — Lynne Gurley
*Assistant Examiner* — Vernon P Webb
(74) *Attorney, Agent, or Firm* — Staas & Halsey LLP

(57) ABSTRACT

An audio processing apparatus and method for a mobile device are provided. The audio processing apparatus and method may appropriately determine sound source localizations corresponding to a voice signal and an audio signal, and thereby may simultaneously provide a voice call service and a multimedia service. Also, the audio processing apparatus and method may guarantee quality of the voice call service even when simultaneously providing the voice call service and the multimedia service.

21 Claims, 6 Drawing Sheets

AUDIO PROCESSING APPARATUS AND METHOD OF MOBILE DEVICE

CROSS-REFERENCE TO RELATED APPLICATIONS

This application claims the benefit of Korean Patent Application No. 10-2008-0104001, filed on Oct. 23, 2008, in the Korean Intellectual Property Office, the disclosure of which is incorporated herein by reference.

BACKGROUND

1. Field

Example embodiments of the following description relate to an audio processing apparatus and method that may simultaneously provide a voice call service and an audio content service.

2. Description of the Related Art

Mobile devices, such as a cellular phone with a voice call function, may provide a variety of functions for a user's convenience. For example, a cellular phone may provide a user with a multimedia service such as music, video, broadcasting contents, as well as a voice call service.

Users wish to be provided with a voice call service and a multimedia service simultaneously. For example, when a voice call is received while being provided with broadcasting contents through a cellular phone, a user desires to use a voice call service without interruption of the broadcasting contents. Accordingly, a cellular phone is required to have a multitasking function capable of simultaneously providing a voice call and broadcasting contents.

However, because a cellular phone is expected to provide a high-quality voice call service, the quality of voice call service must be maintained regardless of a multitasking function. For instance, although a user is provided with voice call and music services simultaneously, the quality of voice call must be maintained.

SUMMARY

Example embodiments may provide an audio processing apparatus and method for a mobile device which determines sound source localizations, corresponding to a voice signal and an audio signal, to be different from each other, and thereby may simultaneously provide a voice call service and a multimedia service without deterioration of voice call quality.

Example embodiments may also provide an audio processing apparatus and method for a mobile device that synthesizes a voice signal and an audio signal using a head related transfer function appropriate for a sound source localization, and thereby may provide a high-quality voice call service.

Example embodiments may also provide an audio processing apparatus and method for a mobile device which controls a location, distance, or intensity of a sound source according to an operation of a user, and thereby may improve convenience to the user.

According to example embodiments, an audio processing apparatus for a mobile device may be provided. The audio processing apparatus may include a signal providing unit to provide a voice signal and at least one audio signal distinguishable from the voice signal, and a sound source localization unit to determine sound source localizations corresponding to the voice signal and the at least one audio signal.

The audio processing apparatus may further include a distance/intensity adjustment unit to determine at least one of a distance from a user to the determined sound source localizations and an intensity of the voice signal or the at least one audio signal at the determined sound source localizations, and a synthesis unit to synthesize the voice signal and the at least one audio signal into at least one predetermined channel.

According to example embodiments, an audio processing method for a mobile device may be provided. The audio processing method may include providing a voice signal and at least one audio signal distinguishable from the voice signal, and determining sound source localizations corresponding to the voice signal and the at least one audio signal.

Additional aspects, features, and/or advantages of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of example embodiments will become apparent and more readily appreciated from the following description, taken in conjunction with the accompanying drawings of which.

DETAILED DESCRIPTION

Figure 1:
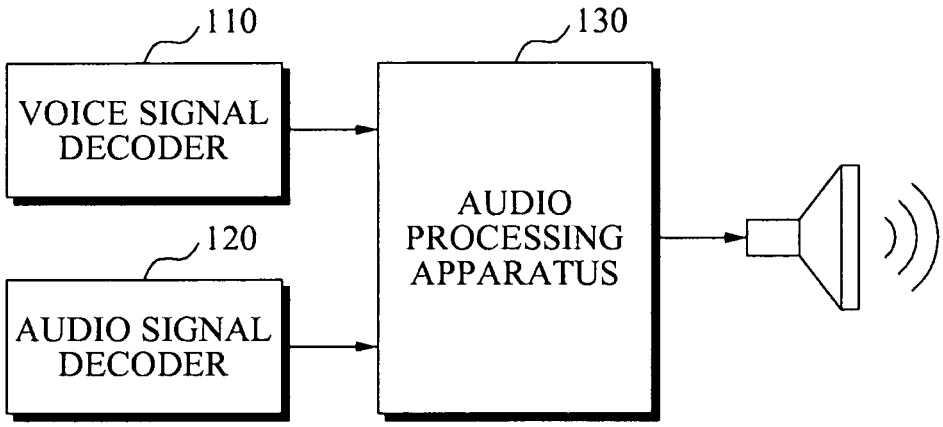
FIG. 1 is a conceptual diagram illustrating a mobile device where an audio processing apparatus may be applied according to example embodiments.

Reference will now be made in detail to example embodiments, which are illustrated in the accompanying drawings, wherein like reference numerals refer to like elements throughout. Example embodiments are described below to explain the present disclosure by referring to the figures.

FIG. 1 is a conceptual diagram illustrating a mobile device where an audio processing apparatus 130 may be applied according to example embodiments.

Referring to FIG. 1, the mobile device according to example embodiments may include, for example, a voice signal decoder 110, an audio signal decoder 120, and the audio processing apparatus 130. An output of the audio processing apparatus 130 may be reproduced by a speaker.

The mobile device may include a variety of terminals providing a voice call function such as a cellular phone, Personal Digital Assistant (PDA), and the like.

The voice signal decoder 110 may decode a voice signal generated due to a voice call or a video call of a user.

The mobile device may provide the user with the voice call or the video call as well as a multimedia service such as music, video, and broadcasting contents. In this instance, an audio signal, generated due to the multimedia service such as music, video, and broadcasting contents, may be processed by the audio signal decoder 120.

The audio processing apparatus 130 may appropriately process the voice signal and audio signal, and thereby may provide the process result to the speaker. Since the user desires to be provided with the voice call service and the multimedia service simultaneously, the audio processing apparatus 130 should simultaneously process the voice signal and the audio signal to provide the voice call service without interruption of the multimedia service. In this instance, the user may hear the voice signal and the audio signal simultaneously.

However, even when the user hears the voice signal and the audio signal simultaneously, the quality of the voice call service should be guaranteed. In this instance, the audio processing apparatus 130 may determine sound source localizations of the audio signal and the voice signal appropriately through a spatial image process, and thereby may provide the multimedia service while maintaining the quality of the voice call service. That is, the audio processing apparatus 130 may appropriately determine the sound source localizations of the audio signal and the voice signal in space.

Figure 2:
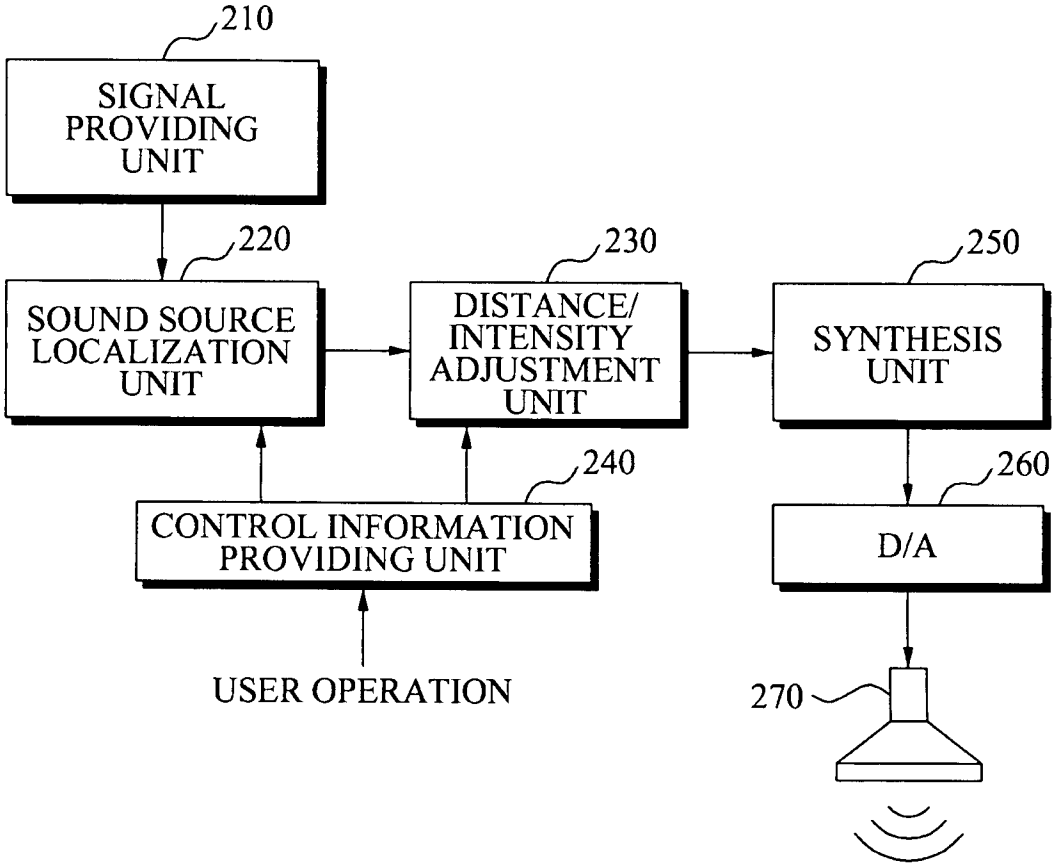
FIG. 2 is a block diagram illustrating an audio processing apparatus according to example embodiments.

FIG. 2 is a block diagram illustrating an audio processing apparatus according to example embodiments.

Referring to FIG. 2, the audio processing apparatus may include, for example, a signal providing unit 210, a sound source localization unit 220, a distance/intensity adjustment unit 230, a control information providing unit 240, a synthesis unit 250, a digital to analog converter 260, and a speaker 270.

The signal providing unit 210 may provide a voice signal and at least one audio signal. The at least one audio signal is distinguishable from the voice signal, and may include an audio signal with music, video, broadcasting contents, and the like. The signal providing unit 210 may output digital signals.

A sampling rate of the voice signal may generally be less than a sampling rate of the audio signal. In this instance, the signal providing unit 210 may adjust the sampling rates of the voice signal and the audio signal to be identical. For example, the signal providing unit 210 may perform up-sampling with respect to the voice signal or perform down-sampling with respect to the audio signal in order to adjust the sampling rates of the voice signal and the audio signal to be the same.

In addition, the voice signal may generally be compressed or restored in a time domain. Also, it may be efficient to perform a spatial image process with respect to the voice signal and the audio signal in a frequency domain. In this instance, the signal providing unit 210 may convert the voice signal in the time domain into the voice signal in the frequency domain. In this case, the sound source localization unit 220 may determine sound source localizations of the voice signal and the audio signal in the frequency domain.

Also, a voice signal decoder and an audio signal decoder, not illustrated in FIG. 2, may generally decode at every frame. In general, since a frame size of the voice signal is not identical to a frame size of the audio signal, the signal providing unit 210 may buffer at least one of the voice signal and the audio signal, and thereby may adjust the frame size of the voice signal and the audio signal for the spatial image process.

Also, the sound source localization unit 220 may determine sound source localizations corresponding to the voice signal and the audio signal. For example, when a plurality of spatial channels exists, each of the voice signal and the audio signal may be mapped into at least one spatial channel. That is, the sound source localizations of the voice signal and the audio signal may be appropriately separated in space. Accordingly, even when a user simultaneously hears the voice signal and the audio signal, the voice signal may be distinguished from the audio signal. Also, when voice call quality is required to be guaranteed, the sound source localization unit 220 may determine the sound source localizations to enable the user to recognize the voice signal more readily than the audio signal.

For example, it may be assumed that the voice signal is a mono signal, and the audio signal is a stereo signal. In this instance, the sound source localization unit 220 may determine a sound source localization of the voice signal to be close to a center of the user and a sound source localization of the audio signal to be close to at least one of a left and a right side of the user, in order to guarantee the quality of the voice call. In this instance, a sound source localization of a voice signal, which is the mono signal, may be determined to be at the left or the right side of the user.

Also, the sound source localization unit 220 may determine up to a predetermined number of the sound source localizations. For example, when 10 available spatial channels exist, the sound source localization unit 220 may determine four spatial channels, of the 10 spatial channels, for the voice signal and the audio signal. Here, directions of the spatial channels may correspond to the sound source localizations.

The distance/intensity adjustment unit 230 may determine a distance from the user to the determined sound source localizations or an intensity of the voice signal or the audio signal at the determined sound source localizations, to enable the user to distinguish the voice signal from the audio signal. In this instance, the distance/intensity adjustment unit 230 may determine the distance or the intensity to enable the user to recognize the voice signal more readily than the audio signal. Here, the distance from the user to the determined sound source localizations may indicate a virtual distance recognized by the user, as opposed to a physical distance.

For example, it may be assumed that a sound source localization of the voice signal is determined to be at 12 o'clock based on a location of the user, and sound source localizations of the at least one audio signal are determined to be at 3 o'clock and 9 o'clock based on the user location. In this instance, the distance/intensity adjustment unit 230 may adjust the sound source localization of the voice signal to be closer to the user, or adjust an intensity of the voice signal to be higher, to enable the user to recognize the voice signal more readily than the at least one audio signal.

Also, the sound source localizations, the distance from the user to the sound source localizations, and the intensity of the voice signal or the audio signal each may be adjusted by an operation of the user. That is, the user may change the sound source localizations, the distance from the user to the sound source localizations, and the intensity of the voice signal or the audio signal through a variety of operations, while being provided with a voice call service and a multimedia service. In this instance, the control information providing unit 240 may provide control information, corresponding to the operation of the user, to the sound source localization unit 220 or the distance/intensity adjustment unit 230 in response to the operation of the user.

The synthesis unit 250 may synthesize the voice signal and the audio signal at the determined virtual sound source localizations to at least one channel.

For example, it may be assumed that the speaker 270 uses two channels, and that four sound source localizations of the voice signal and the audio signal exist. In this instance, the synthesis unit 250 may synthesize the voice signal and the audio signal, while each of the voice signal and the audio signal maintains a spatial direction. Also, the synthesis unit 250 may generate four pieces of binaural sound transmitted through the two channels. That is, although the user physically hears the binaural sounds transmitted through the two channels, the user may perceive the voice signal and the audio signal to come through four spatial channels.

Here, it may be assumed that the user is capable of recognizing a direction of sound through only two ears in a binaural sound system. Specifically, the binaural sound system may generate a binaural sound using head related transfer functions, corresponding to sound source localizations, to enable the user to recognize the sound source localizations based on sound that the user hears through two ears in space.

Also, the head related transfer functions may vary depending on the sound source localizations. In this instance, the head related transfer functions, corresponding to the sound source localizations, may be measured in advance through simulation experiments. The synthesis unit 250 may appropriately select the head related transfer functions corresponding to the sound source localizations using a database storing the measured head related transfer functions.

The audio processing apparatus may generate the binaural sounds using the head related transfer functions, and thereby may enable the user to determine the sound source localizations appropriately and distinguish the voice signal from the audio signal. Accordingly, the voice call service and the multimedia service may be simultaneously and efficiently provided to the user, and the quality of the voice call service may be guaranteed.

Also, the digital to analog converter 260 may convert the generated binaural sounds corresponding to the sound source localizations into an analog signal. The converted analog signal may be reproduced through the speaker 270.

However, when the binaural sounds are reproduced through the speaker 270 as opposed to a headphone or an earphone, crosstalk may occur. Technologies to remove crosstalk may be additionally applied.

Figure 3:
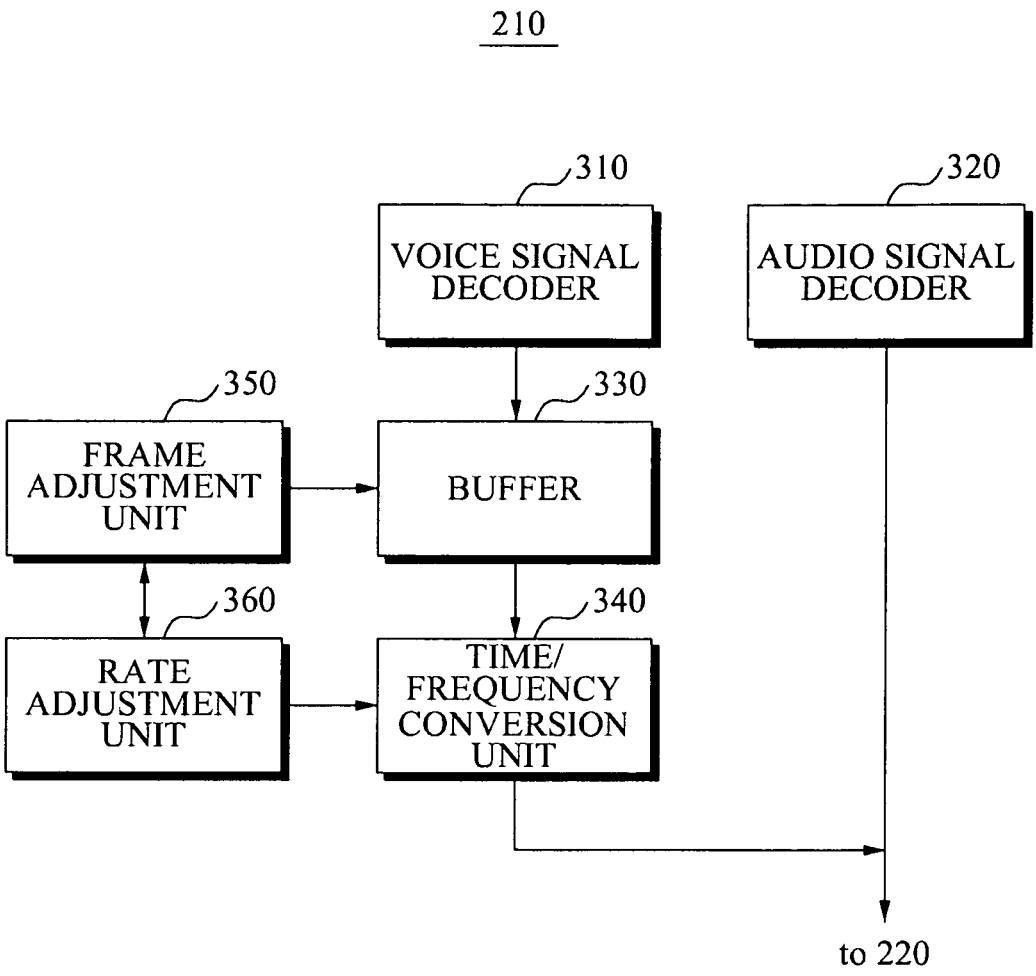
FIG. 3 is a block diagram illustrating an example of a signal providing unit of FIG. 2.

FIG. 3 is a block diagram illustrating an example of the signal providing unit 210 of FIG. 2.

Referring to FIG. 3, the signal providing unit 210 may include, for example, a voice signal decoder 310, an audio signal decoder 320, a buffer 330, a time/frequency conversion unit 340, a frame adjustment unit 350, and a rate adjustment unit 360.

The voice signal decoder 310 may provide a decoded voice signal and the audio signal decoder 320 may provide a decoded audio signal. In this instance, the voice signal decoder 310 and the audio signal decoder 320 may decode at every frame.

The buffer 330 may buffer the voice signal to adjust a frame size of the voice signal to a frame size of the audio signal, since it may be efficient that a frame size for a spatial image process is fixed. However, the frame size of the audio signal may be adjusted to the frame size of the voice signal.

The time/frequency conversion unit 340 may convert a voice signal in a time domain into a voice signal in a frequency domain. In general, the voice signal decoder 310 may decode in the time domain, whereas the audio signal decoder 320 may decode in the frequency domain. Accordingly, the time/frequency conversion unit 340 may generate the voice signal in the frequency signal to efficiently perform the spatial image process.

The frame adjustment unit 350 may control the buffer 330 and the time/frequency conversion unit 340 to adjust the frame size of the voice signal to the frame size of the audio signal.

The rate adjustment unit 360 may control the buffer 330 and the time/frequency conversion unit 340 to adjust sampling rates of the voice signal and the audio signal to be identical. In general, each of the sampling rates of the voice signal is less than the sampling rate of the audio signal. The sampling rates of the voice signal and the audio signal may be identical by up-sampling the voice signal.

Figure 4:
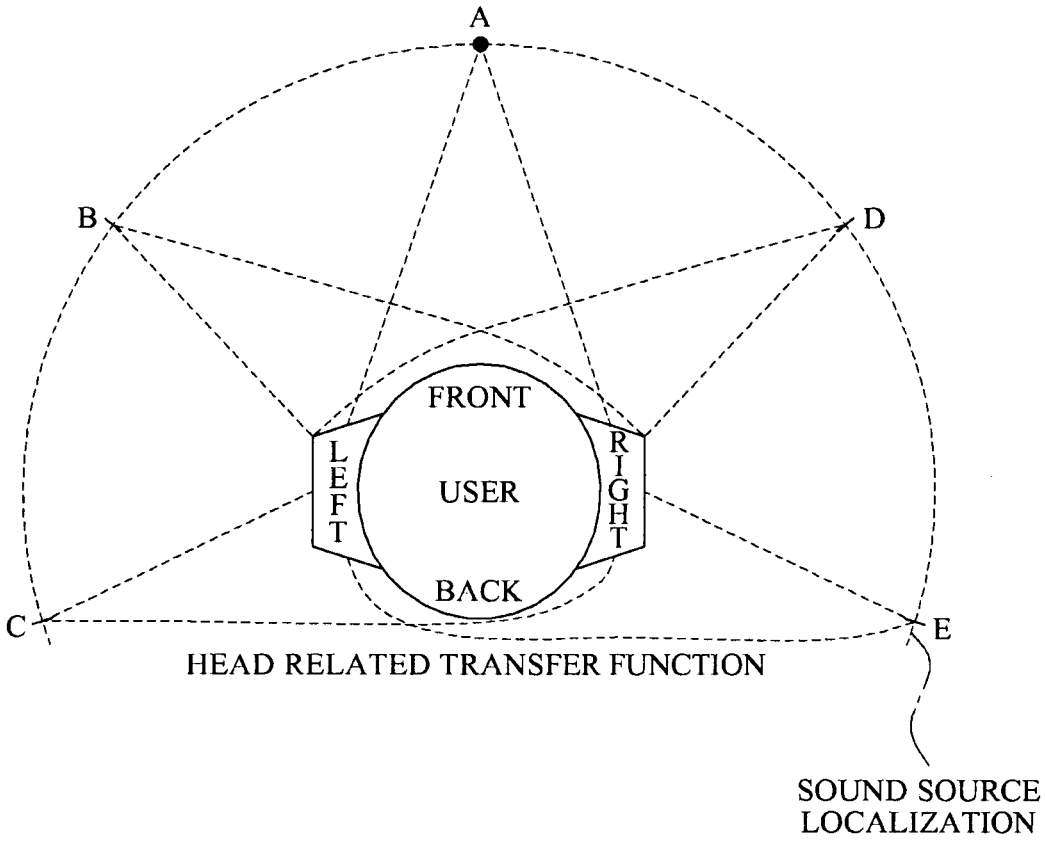
FIG. 4 is a diagram illustrating head related transfer functions depending on sound source localizations.

FIG. 4 is a diagram illustrating head related transfer functions depending on sound source localizations.

Referring to FIG. 4, it may be ascertained that a virtual space is formed based on a user. A plurality of sound source localizations A, B, C, D, and E exist in the virtual space. Sound source localization A is located in front of the user. Sound source localizations D and E are located on a right side of the user, and sound source localizations B and C are located on a left side of the user.

The user hears binaural sound through two ears and may recognize sound source localizations based on the binaural sound. In this instance, the binaural sound may be generated using head related transfer functions corresponding to the sound source localizations. For example, the user may recognize that sound is generated at the sound source localization D by hearing binaural sound $S_D$ generated using a head related transfer function $H_D$ corresponding to the sound source localization D through the two ears of the user.

Head related transfer functions applied to an audio processing apparatus according to example embodiments may vary depending on sound source localizations. The head related transfer functions may mainly include an Inter-aural Intensity Difference (IID) and an Inter-aural Time Difference (ITD). IID may be a difference in levels between sound heard in each of two ears of the user, and ITD may be a time difference between sounds heard in each of the two ears of the user. In this instance, a head related transfer function corresponding to each of the sound source localizations may be obtained using IID and ITD previously stored with respect to each frequency band.

The audio processing apparatus may previously store the head related transfer functions corresponding to each of the sound source localizations in a database, select the head related transfer functions, and thereby may generate the binaural sounds.

Figure 5:
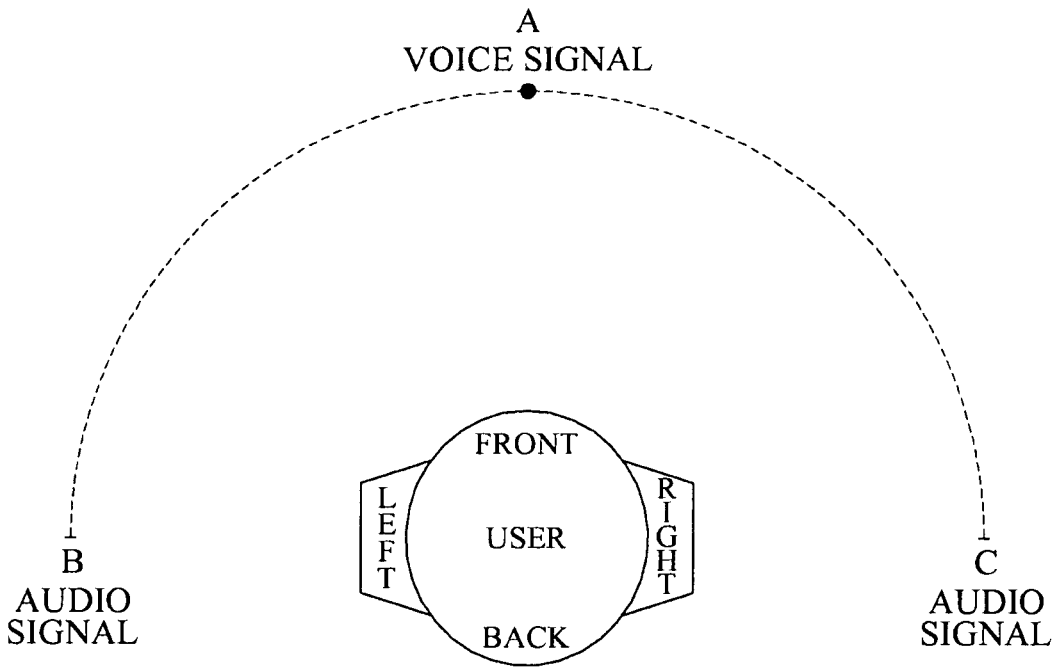
FIG. 5 is a diagram illustrating sound source localizations of a voice signal and audio signals according to example embodiments.

FIG. 5 is a diagram illustrating sound source localizations of a voice signal and audio signals according to example embodiments.

Referring to FIG. 5, it may be ascertained that the voice signal is located in front of a user, that is, at a sound source localization A, and the audio signals are located on a left side of the user, that is, at a sound source localization B, and on a right side of the user, at a sound source localization C.

It may be assumed that a head related transfer function $H_A$ corresponding to the sound source localization A is applied to the voice signal, and a head related transfer function $H_B$ corresponding to the sound source localization B and a head related transfer function $H_C$ corresponding to the sound source localization C are applied to the audio signals. Also, it may be assumed that binaural sounds $S_A$, $S_B$, and $S_C$ are generated. In this instance, the user may distinguish the sound source localization A of the voice signal from the sound source localizations B and C of the audio signals using the binaural sounds $S_A$, $S_B$, and $S_C$.

Figure 6:
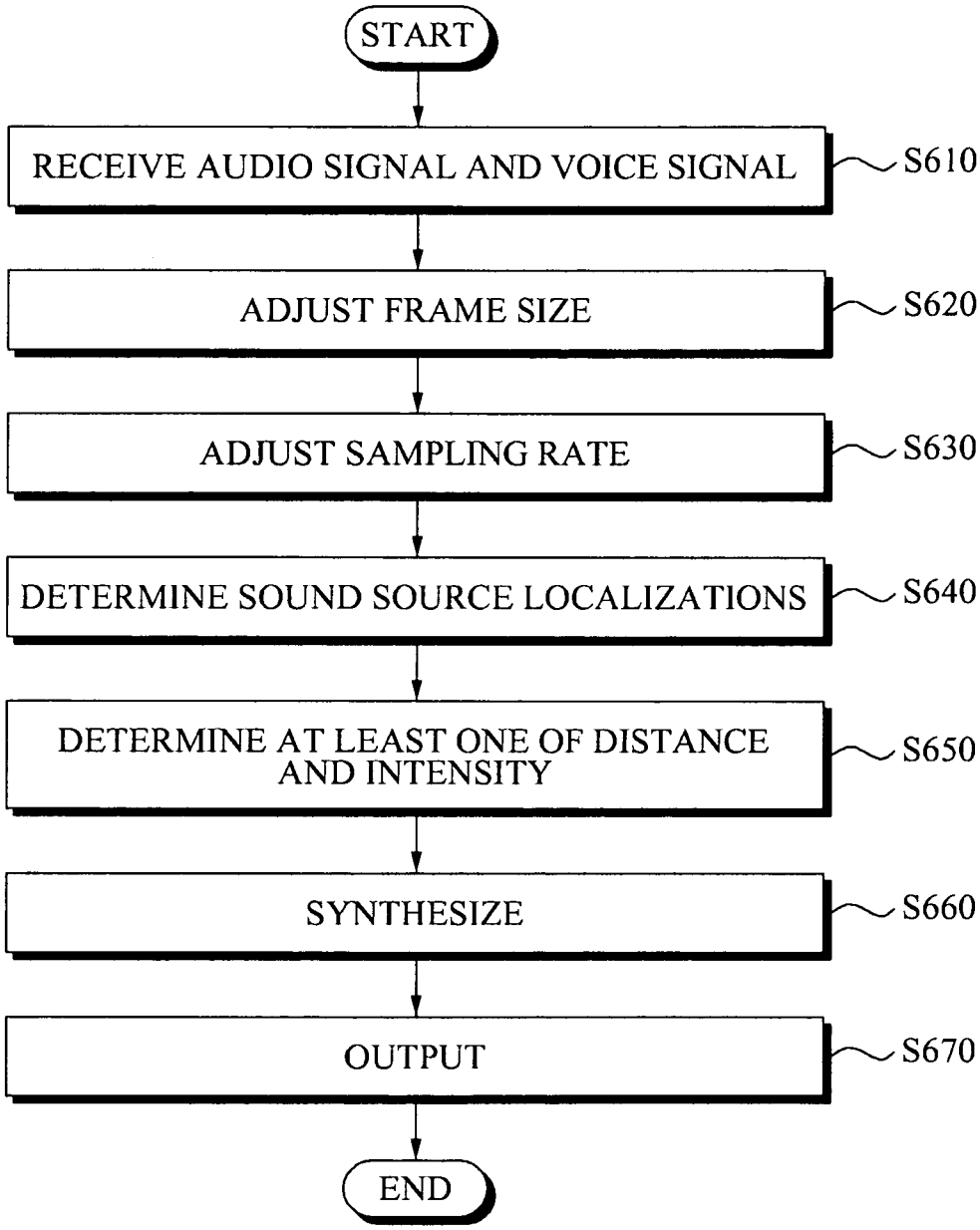
FIG. 6 is a flowchart illustrating an audio processing method according to example embodiments.

FIG. 6 is a flowchart illustrating an audio processing method according to example embodiments.

Referring to FIG. 6, in operation S610, the audio processing method may receive a voice signal and at least one audio signal distinguishable from the voice signal.

In operation S620, the audio processing method may adjust a frame size of the voice signal and a frame size of the audio signal to be the same to efficiently perform spatial image processing.

In operation S630, the audio processing method may perform up-sampling or down-sampling with respect to at least one of the voice signal and the audio signal, and thereby may adjust sampling rates of the voice signal and the audio signal to be identical.

In operation S640, the audio processing method may determine sound source localizations corresponding to the voice signal and the at least one audio signal.

In operation S650, the audio processing method may determine at least one of a distance from a user to the determined sound source localizations and an intensity of the voice signal, or the at least one audio signal, at the determined sound source localizations.

In operation S660, the audio processing method may synthesize the voice signal and the at least one audio signal into at least one predetermined channel.

In operation S670, the audio processing method may output a signal, generated by synthesizing, through a speaker, headphone, or earphone.

The audio processing method according to the above-described example embodiments may be recorded as computer readable code/instructions in/on a computer-readable media including program instructions to implement various operations embodied by a computer. The media may also include, alone or in combination with the program instructions, data files, data structures, and the like. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described example embodiments, or vice versa.

Although a few example embodiments have been shown and described, the present disclosure is not limited to the described example embodiments. Instead, it would be appreciated by those skilled in the art that changes may be made to these example embodiments without departing from the principles and spirit of the disclosure, the scope of which is defined by the claims and their equivalents.

What is claimed is:

1. An audio processing apparatus for a mobile device, the audio processing apparatus comprising:

a signal providing unit to provide a voice signal and at least one audio signal distinguishable from the voice signal, wherein the voice signal is a monaural signal and the at least one audio signal is a stereo signal and wherein the signal providing unit comprises a frame adjustment unit to adjust a frame size of the voice signal and the at least one audio signal to be substantially identical; and a sound source localization unit to determine sound source localizations corresponding to the voice signal and the at least one audio signal.

2. The audio processing apparatus of claim 1, further comprising:

a synthesis unit to synthesize the voice signal and the at least one audio signal into at least one predetermined channel.

3. The audio processing apparatus of claim 2, wherein the synthesis unit synthesizes the voice signal and the at least one audio signal and generates a binaural sound to enable the sound source localizations to be recognized by a user.

4. The audio processing apparatus of claim 2, wherein the synthesis unit synthesizes the voice signal and the at least one audio signal using head related transfer functions corresponding to the determined sound source localizations.

5. The audio processing apparatus of claim 4, wherein the head related transfer functions are selected from a plurality of functions previously stored according to the determined sound source localizations.

6. The audio processing apparatus of claim 1, wherein the sound source localization unit determines up to a predetermined number of the sound source localizations.

7. The audio processing apparatus of claim 1, wherein the sound source localization unit determines the sound source localizations to enable a user to recognize the voice signal more readily than the at least one audio signal.

8. The audio processing apparatus of claim 1, wherein the sound source localization unit determines a sound source localization corresponding to the voice signal to be closer to a center of a user than a sound source localization corresponding to the at least one audio signal.

9. The audio processing apparatus of claim 1, further comprising:

a distance/intensity adjustment unit to determine at least one of a distance from a user to the determined sound source localizations and an intensity of the voice signal or the at least one audio signal at the determined sound source localizations.

10. The audio processing apparatus of claim 9, wherein the distance/intensity adjustment unit determines the distance from the user to the determined sound source localizations, or determines the intensity of the voice signal or the at least one audio signal at the determined sound source localizations, to enable the user to recognize the voice signal more readily than the at least one audio signal.

11. The audio processing apparatus of claim 9, further comprising:

a control information providing unit to provide control information according to an operation of the user, wherein the distance/intensity adjustment unit determines at least one of the distance from the user to the determined sound source localizations, and the intensity of the voice signal or the at least one audio signal at the determined sound source localizations, based on the control information.

12. The audio processing apparatus of claim 1, further comprising:

a control information providing unit to provide control information, wherein the sound source localization unit determines the sound source localizations based on the provided control information.

13. The audio processing apparatus of claim 12, wherein the control information providing unit provides the control information according to an operation of the user.

14. An audio processing apparatus for a mobile device, the audio processing apparatus comprising:

a signal providing unit to provide a voice signal and at least one audio signal distinguishable from the voice signal, wherein the voice signal is a monaural signal and the at least one audio signal is a stereo signal and wherein the signal providing unit further comprises:

a frame adjustment unit to adjust a frame size of the voice signal and the at least one audio signal to be substantially identical; and a rate adjustment unit to adjust the voice signal and the at least one audio signal to have a substantially identical sampling rate; and a sound source localization unit to determine sound source localizations corresponding to the voice signal and the at least one audio signal.

15. The audio processing apparatus of claim 1, wherein the signal providing unit comprises a time/frequency conversion unit to convert the voice signal in a time domain into the voice signal in a frequency domain.

16. An audio processing method for a mobile device, the audio processing method comprising:

providing a voice signal and at least one audio signal distinguishable from the voice signal, wherein the voice signal is a monaural signal and the at least one audio signal is a stereo signal adjusting a frame size of the voice signal and the at least one audio signal to be substantially identical; and determining sound source localizations corresponding to the voice signal and the at least one audio signal using the mobile device.

17. The audio processing method of claim 16, further comprising:

synthesizing the voice signal and the at least one audio signal into at least one predetermined channel.

18. The audio processing method of claim 16, further comprising:

determining at least one of a distance from a user to the determined sound source localizations, and an intensity of the voice signal or the at least one audio signal at the determined sound source localizations at the determined sound source localizations.

19. A computer-readable recording medium storing computer readable code including a program for implementing an audio processing method for a mobile device, the audio processing method comprising:

providing a voice signal and at least one audio signal distinguishable from the voice signal, wherein the voice signal is a monaural signal and the at least one audio signal is a stereo signal;

adjusting a frame size of the voice signal and the at least one audio signal to be substantially identical; and determining sound source localizations corresponding to the voice signal and the at least one audio signal.

20. The audio processing apparatus of claim 1, wherein the sound source localization unit determines a sound source localization of the voice signal to be close to a center of the user and a sound source local localization of a left channel of the audio signal to be close to a left of the user and a sound source local localization of a right channel of the audio signal to be close to a right of the user.

21. The audio processing apparatus of claim 1, wherein the signal providing unit further comprises a rate adjustment unit to adjust a sampling rate of at least one of the voice signal and the at least one audio signal.

* * * * *

UNITED STATES PATENT AND TRADEMARK OFFICE

CERTIFICATE OF CORRECTION

PATENT NO. : 8,542,839 B2
APPLICATION NO. : 12/382562
DATED : September 24, 2013
INVENTOR(S) : Chang Yong Son et al.

It is certified that error appears in the above-identified patent and that said Letters Patent is hereby corrected as shown below:

In the Claims:

In Column 9, Lines 23-24, In Claim 18, after "signal" delete "at the determined sound source localizations".

Signed and Sealed this
Eighteenth Day of February, 2014

Michelle K. Lee

Michelle K. Lee
*Deputy Director of the United States Patent and Trademark Office*